US006478899B1

(12) United States Patent
Legrand et al.

(10) Patent No.: US 6,478,899 B1
(45) Date of Patent: Nov. 12, 2002

(54) INSTALLATION FOR MAKING COLD ROLLED STAINLESS STEEL BANDS

(75) Inventors: Hugues Legrand, Sewickley, PA (US); Luc Vendeville, Bethune (FR); Jean Veyer, Aire sur la Lys (FR); Francis Chassagne, Isbergues (FR); Jean-Michel Damasse, Isbergues (FR); Yann Breviere, Ecquedecques (FR); Henri Giraud, Gueugnon (FR); Jean-Pierre Malingriaux, Norrent-Fontes (FR); Michel Ternisien, Busnes (FR); Bernard Tetu, Saint Vital (FR); Bernard Vialatte, Uxeale (FR)

(73) Assignee: Ugine S.A., Puteaux (FR)

( * ) Notice: Subject to any disclaimer, the term of this patent is extended or adjusted under 35 U.S.C. 154(b) by 0 days.

(21) Appl. No.: 09/623,015

(22) PCT Filed: Feb. 22, 1999

(86) PCT No.: PCT/FR99/00388

§ 371 (c)(1),
(2), (4) Date: Oct. 10, 2000

(87) PCT Pub. No.: WO99/43451

PCT Pub. Date: Sep. 2, 1999

(30) Foreign Application Priority Data

Feb. 25, 1998 (FR) ..... 98 02264

(51) Int. Cl.[7] ..... C21D 8/02

(52) U.S. Cl. ..... 148/541; 148/542; 148/610; 148/603; 266/103; 164/417; 164/476

(58) Field of Search ..... 148/541, 542, 148/610, 603; 266/103; 164/417, 476

(56) References Cited

FOREIGN PATENT DOCUMENTS

JP 407331330 A * 12/1995 ..... C21D/8/02
JP 410296402 A * 11/1998 ..... B22D/11/06

* cited by examiner

*Primary Examiner*—Deborah Yee

(57) ABSTRACT

A stainless steel band is continuously cast. The stainless steel band is descaled and cold rolled. The cold rolled band is annealed and descaled or bright annealed. The band is finish formed and finally coiled. The stainless steel band is not coiled after being continuously cast and before being finally coiled.

24 Claims, 1 Drawing Sheet

INSTALLATION FOR MAKING COLD ROLLED STAINLESS STEEL BANDS

FIELD OF THE INVENTION

The invention relates to the fabrication of stainless steel strip. To be more precise, it relates to an installation for producing stainless steel strip combining all fabrication process steps from casting to cold rolling.

BACKGROUND OF THE INVENTION

Cold-rolled stainless steel strip to be shipped to customers in coiled form is usually made by the following process:

- continuously casting slabs approximately 15 to 25 cm thick from liquid steel in a bottomless mould with cooled fixed walls,
- hot rolling the slabs to form a strip a few millimeters thick,
- optional initial annealing of the strip,
- descaling and cleaning the surface of the strip by mechanical, chemical or electrochemical means or a succession of such means,
- cold rolling the strip to virtually its final thickness, generally in a rolling mill including a plurality of mill stands,
- annealing,
- pickling, and
- passing through a skin-pass rolling mill before final packaging in coiled form.

The cold rolling can also be carried out in several steps separated by intermediate treatments.

Annealing and pickling after cold rolling can be replaced by bright annealing, depending on the required surface state and appearance of the strip.

The above operations are carried out on installations which are mostly separate from one another, and this necessitates multiple packaging operations, such as intermediate coiling operations, and transferring coils from one installation to another.

However, it is known in the art to perform the steps of transforming the hot-rolled strip to cold-rolled coiled strip ready for sale on a single installation, in which the steps are performed in-line. The document EP 0 695 808 describes one example of this.

The above document also mentions the possibility of carrying out the above transformation steps not on strip produced from hot-rolled slabs but on strip produced by an installation for direct continuous casting of thin strip a few millimeters thick from the liquid metal, for example by casting the liquid metal between two internally cooled horizontal axis rolls. Casting can optionally be followed by light hot rolling performed on the same line as the casting or on a completely separate installation, with the particular aim of limiting the surface roughness of the strip and encouraging recrystallization of the metal to prevent "roping" during subsequent transformation of the strip. An annealing furnace can also be placed downstream of the hot rolling mill and upstream of the installation for coiling the strip.

In any event, the production line for cold-rolled stainless steel strip is long and represents a heavy investment. It is also costly in terms of energy consumption because of the multiple operations of transporting intermediate product (slabs and coils) between installations which are not always on the same industrial site and because of the reheating of the product which is necessary before several of the cited operations to raise it from ambient temperature to the required treatment temperature. What is more, storing intermediate product pending processing takes up space and immobilizes metal.

Using an installation for direct casting of thin strip reduces these drawbacks and eliminates the hot rolling step or at least considerably reduces its scale. What is more, if hot rolling is performed in-line, without intermediate coiling, the latent heat of the strip that has just been cast is a benefit.

Problems with the surface quality of the strip remain, however. It is difficult always to avoid to a sufficient degree the presence of encrusted scale on the surface of the strip obtained after treatment. Also, on the more fragile grades of steel, such as SUS 409 ferritic stainless steel, surface cracks frequently appear on the finished strip and render it unusable.

SUMMARY OF THE INVENTION

The object of the invention is to propose a method of fabricating cold-rolled stainless steel strip which regularly achieves a very good surface quality of said strip and a fabrication installation suited to the use of the method.

With the above objectives in view, the invention provides a method of fabricating thin stainless steel strip in which the following steps are carried out successively and continuously on a single processing line:

- continuously casting a stainless steel strip directly from liquid metal,
- descaling said strip,
- cold rolling said strip,
- annealing and pickling or bright annealing said strip,
- finishing said strip, for example by passing it through a skin-pass rolling mill, and
- coiling said strip.

Said strip can optionally be hot rolled immediately after casting it and this hot rolling can be followed by annealing of said strip.

The invention also proposes an installation for producing cold-rolled stainless steel strip, the installation including, in succession:

- an installation for continuously casting thin strip directly from liquid metal,
- a descaling installation,
- a cold rolling installation,
- an annealing-pickling installation or a bright annealing installation,
- an installation for finishing the strip, such as a skin-pass rolling mill, and
- an installation for coiling the strip, all said installations being disposed on a common continuous line and at least some of them being separated by a strip accumulator.

The installation optionally also includes a hot rolling mill downstream of the continuous casting installation. The hot rolling mill can be followed by an annealing installation.

The casting installation can be of the "twin-roll casting" type.

The invention clearly consists of continuously executing on a single production line all the process steps for fabricating cold-rolled stainless steel strip from thin strip cast directly from liquid metal, from the casting step through finishing steps to packaging the strip in the form of a coil ready for shipping to the customer.

The inventors have realized that the residual encrustation of scale and the surface cracks found all too often on cold-rolled strip made on conventional discontinuous installations are considerably reduced by eliminating all the intermediate coiling operations that the strip normally has to undergo before it is transferred from one shop to another. Coiling inevitably subjects the strip to tension, which can be sufficient to damage particularly fragile grades, either during coiling itself or during the period in which the cooled, and therefore relatively unmalleable, strip remains coiled. Also, the time the strip spends in the form of tightly wound turns contributes to deeply encrusting into its surface layers any residual scale remaining on its surface if it is imperfectly cleaned before coiling. Eliminating all the intermediate coiling operations, which is allowed by the method according to the invention and the entirely continuous production line according to the invention therefore eliminates major causes of deterioration of the surface quality of the strip.

Other advantages of the invention may also be cited.

Each coiling operation considerably deforms the beginning and the end of the strip constituting the coil. It therefore renders those parts unusable and, what is more, they could damage the parts of the installation that they pass through in the next process step. It is therefore essential to remove them. Eliminating intermediate coiling operations in the method according to the invention therefore reduces the quantity of metal rendered unusable during the fabrication process and likewise the number of installations for shearing the beginning and end of the strip.

The processing line according to the invention can be relatively compact and in any event has a smaller footprint than the discontinuous (and often geographically dispersed) installations that it replaces. What is more, it becomes a simple matter to group together on one site and close to the line various shops whose functions are common to different parts of the installation.

The operations of transferring coils from one installation to another are eliminated, saving considerable time in the total duration of the fabrication process. Also, the usual coil transfers have the drawback of immobilizing metal, which is not yet ready to be shipped to customers, and therefore immobilizing capital on which no return is yet possible. What is more, the coils awaiting processing must be stored and the storage areas increase the size of the factory. The invention enables the factory producing the cold-rolled strip to operate on a "just in time" basis with the usual economic advantages of that type of operation.

The use of a conventional installation for continuously casting slabs produces large quantities of highly adherent scale after casting and before and immediately after hot rolling. Experience shows that direct continuous casting of thin strip reduces the total quantity of scale formed after casting, and after optional hot rolling, especially if an inert atmosphere is used in the lower part of the casting plant, for example using a cover under which a non-oxidizing or even reducing atmosphere is maintained. What is more, the scale that does form is less strongly adherent to the surface of the product than the scale formed in conventional casting and hot rolling installations, which is probably due to the shorter time for which the product remains at high temperatures. Consequently, the user has two options for putting the invention into practice.

The first option is to obtain cold-rolled strip with a surface quality that is very regularly greater than that of the usual strip. To this end the line retains the same descaling tools as are used on conventional installations, in particular prior to cold rolling. Those tools usually include, in succession:

- a scale breaker in which the hot-rolled strip is flexed and slightly stretched, which fractures the layer of scale,
- one or more mechanical descaling tools, which can include, alone or in cascade, a shot peening installation, a brushing installation, and an installation for spraying a fluid under pressure, the function of the last two tools being essentially to complete the removal of some of the residual scale detached by shot peening and any shot remaining on the surface of the strip, and
- a chemical and/or electrolytic pickling installation, which can include one or more similar or different baths with composition(s) chosen in accordance with the usual parameters, such as the grade of the steel (which determines in part the composition and the behaviour of the scale), the type of surface finish required for the strip and the required treatment time. It may be necessary to cool the strip before it enters the pickling bath(s) if the temperature of the strip is relatively high on leaving the mechanical descaling facility (which can be the case in particular if it has undergone hot rolling followed by intermediate annealing).

The second option for using the method according to the invention entails being content with a regular surface quality of the strip that is merely comparable with that obtained by the conventional processes, from the point of view of encrustation of scale, but obtaining this result using a simplified descaling installation, which is therefore less costly to construct and to operate. The following options are available, for example:

- dispensing with the scale breaker or limiting the severity of its action, which would be favourable to reducing the risk of surface cracks appearing on more fragile strip,
- reducing the intensity of shot peening, or eliminating it completely, to obtain a strip surface that is less rough and less work-hardened, and
- reducing the number of mechanical descaling tools and/or the number of pickling baths.

For grades for which an optimum surface quality is not necessarily required (for example steel for manufacturing automobile exhaust systems) it is even feasible to eliminate pickling entirely. In this case it is no longer necessary to cool the strip when it leaves the mechanical descaling facility, even if it has undergone hot rolling and intermediate annealing beforehand. Cold rolling can then be started at a higher temperature than usual, and possibly with a greater reduction ratio than usual (by adding extra mill stands or by increasing the reduction ratio of the existing mill stands). This opens up new possibilities in the fabrication of the product.

BRIEF DESCRIPTION OF THE DRAWING

The single FIGURE of the accompanying drawing is a diagram showing one example of an installation according to the invention.

DETAILED DESCRIPTION OF THE INVENTION

Figure 1:
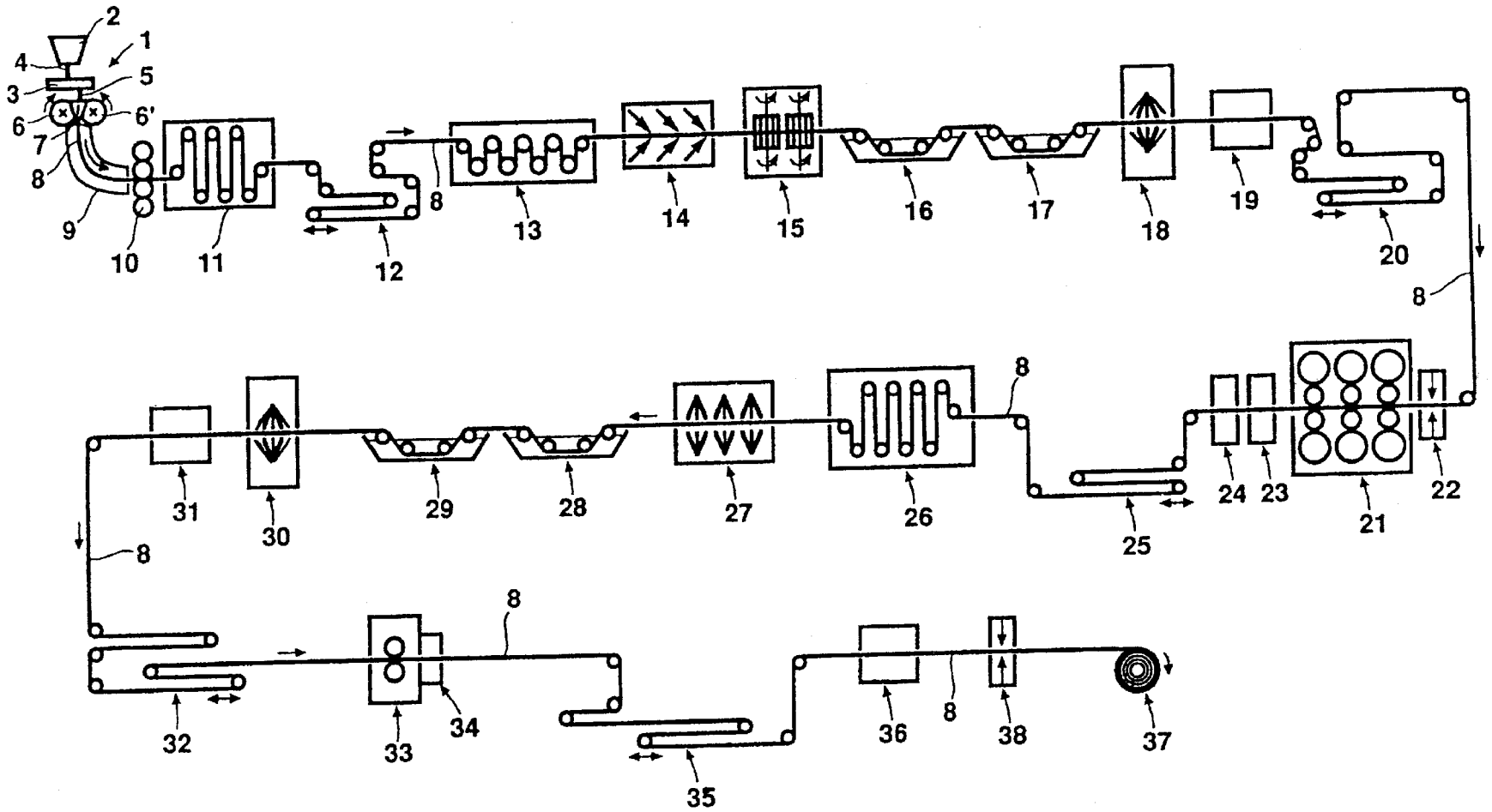

It includes firstly an installation 1 for continuously casting thin strip and made up of a ladle 2 containing liquid steel to be cast, a tundish 3 collecting a jet 4 of liquid steel and feeding a jet 5 of liquid steel to a mould comprising two internally cooled horizontal axis rolls 6, 6' which rotate in opposite directions. Their cylindrical lateral surfaces delimit a casting space whose smallest width corresponds to the thickness of the strip to be cast and which is shut off laterally by refractory material plates 7 pressed against the ends of the rolls 6, 6'. The liquid steel solidifies in the mould in the form of a thin strip 8 of stainless steel whose thickness is of the order of 1 to 10 mm for this type of casting machine, and it is extracted continuously from the mould by pinch rolls, not shown. The strip 8 then preferably passes through an enclosure 9 in which an atmosphere that has the lowest possible oxidizing capability is maintained, using a neutral gas such as argon or nitrogen or a reducing gas such as hydrogen, to limit the formation of scale on the surface. The walls of the enclosure 9 also reflect radiation from the strip 8 back onto it, so reducing thermal losses from the strip 8. In a manner that is known in the art, the strip then enters a hot rolling mill 10 whose function is to reduce its thickness, to close any internal pores and to cause recrystallization of the grains, which is favourable in particular to avoiding the occurrence of roping in drawn products subsequently made from the strip 8. Then, and again in a manner that is known in the art, the strip 8 enters an annealing furnace 11 if this form of heat treatment is required.

The part of the installation just described corresponds to the usual form of continuous casting installation for thin strip and processing installations that may conventionally be joined directly to it. The casting installation can instead be of a type other than the twin-roll casting type, for example casting between moving bands or on a single cylinder, and produce strip slightly thicker or thinner than the 1 to 10 mm previously cited. Similarly, the hot rolling mill 10 and the annealing furnace 11 are optional, as their presence and use are not necessarily related to the presence and use of the hot rolling mill 10. Conversely, if more complex heat treatment and thermomechanical treatment of the strip 8 just cast is required, it is feasible to install on the production line other plant such as additional furnaces and cooling installations.

The strip 8 then enters a first strip accumulator 12 which separates the "casting-hot treatment" part from the next part of the line, in which the strip 8 is descaled. The accumulator 12 enables the speeds at which the strip 8 moves through the two parts of the line to be independent of each other and makes it possible to continue to feed one of the two parts with metal while the other is temporarily stopped.

On leaving the accumulator 12, the strip 8 enters a scale breaker 13, of a type known in the art, which cracks and weakens the layer of scale that may have formed on the surface of the strip 8 despite the precautions taken. It then enters a shot peening installation 14 in which the scale is disintegrated by spraying metal or ceramic balls onto the surface of the strip 8. The latter is then preferably cleaned of scale residues, and possibly of balls that may have become embedded in it, by a brushing installation 15, which can be complemented or replaced by an installation in which a fluid under pressure is sprayed onto the strip, for example. The cleaning of the surface of the strip 8 is preferably completed by passing the strip 8 through one or more tanks 16, 17 containing chemical and/or electrolytic pickling baths whose natures are conditioned, as known in the art, by the composition of the strip 8, the time for which the strip 8 is required to remain in the baths 16, 17, the type of surface finish required for the strip 8, etc. If necessary, the first pickling bath 16 is preceded by an installation for cooling the strip 8. The tanks are preferably equipped with means enabling the strip 8 to enter them or bypass them, according to what is required at the time. A rinsing installation 18 and a drying installation 19 (and/or any other suitable installation) then eliminate from the surface of the strip 8 any remaining traces of the pickling baths.

The design of the "descaling" part of the line just described, which comprises only components known in the art, can be varied without departing from the invention. Circumstances in which simplifications of this part of the installation can be envisaged and the manner thereof have previously been stated.

The strip 8 then enters a second strip accumulator 20 which separates the "descaling" part of the line from the "cold rolling" part and makes their operation independent.

In the example shown, the "cold rolling" part of the installation according to the invention includes a single conventional rolling mill with three mill stands which roll the strip 8 to virtually its final thickness, although it is to be understood that this configuration is in no way limiting on the invention. A smaller or greater number of mill stands or a Sendzimir rolling mill can be used. The rolling mill 21 is preceded by a shearing machine 22 which cuts the strip 8 to interrupt the feed to the rolling mill 21 when the rolls of the rolling mill 21 are changed. It is not necessary to shut down the upstream part of the installation during this interruption in the operation of the rolling mill 21 because the strip 8 can continue to accumulate in the first and second accumulators 12, 20. In a manner known in the art, the rolling mill 21 is followed by a degreasing installation 23 and a drying installation 24.

As mentioned above, the "cold rolling" section of the installation can include a second cold rolling mill if the strip enters this section at a relatively high temperature, in particular if no pickling installation is used.

The strip 8 then enters a third accumulator 25 which separates the "cold rolling" part from the "annealing-pickling" part of the line and makes their operation independent.

In the example shown, the "annealing-pickling" part of the line begins with a conventional annealing furnace 26 which is followed by cooling installation 27, downstream of which the strip 8 enters chemical and/or electrolytic pickling tanks 28, 29 containing baths whose compositions are known in the art. The tanks 28, 29 are preferably each equipped with means such that, at the choice of the operator, the strip 8 passes through them or bypasses them. The single figure shows two pickling baths, but obviously the number of baths can be smaller or greater, as required. The annealing-pickling processes carried out in this part of the installation according to the invention are not particularly different from the processes usually carried out in conventional cold-rolled strip fabrication installations. The strip 8 then passes through a rinsing installation 30 and a drying installation 31.

The annealing furnace 26 can have an induction heating system at its entry. This provides a high instantaneous heating capacity which quickly heats the strip 8 to its nominal processing temperature. The heating capacity can also be changed easily, which makes it easy to vary the time for which the strip 8 remains in the annealing furnace 26 to perform the required metallurgical treatment by modifying the quantity of energy transferred to the strip 8 by the induction heating system. This provides an additional degree of freedom in controlling the line as a whole.

As already stated, the "annealing-pickling" part just described can be replaced by a bright annealing installation, depending on the type of product to be fabricated.

The strip 8 then enters a fourth accumulator 32 which separates the "annealing-pickling" part from the skin-pass rolling mill 33 and makes their operation independent.

The skin-pass rolling mill 33, which can be complemented by a tension leveller 34, has the conventional function of conferring on the strip its final metallurgical structure and surface state, which goes hand in hand with a very slight reduction in its thickness. Once again, this mill of the installation according to the invention is no different to those conventionally used on prior art cold rolling lines.

The strip 8 then enters a fifth accumulator 35 which separates the skin-pass rolling mill 33 from the "coiling" part of the line and enables the coiling tension and speed of the strip 8 to be adjusted independently of the speed at which the strip passes through the skin-pass rolling mill 33.

After leaving the accumulator 35 the strip preferably passes through trimmers 36 which cut off the edges of the strip, which are not of sufficient metallurgical quality to be used. It is then packaged on a coiling machine 37 preceded by shears 38 which cut the strip 8 when the coiling machine 37 is almost full. Only one coiling machine 37 is shown, but clearly there must be at least two of them so that the strip can be fed to the empty coiling machine as soon as the other one is filled, as on traditional cold rolling lines.

As an alternative to this, if it is deemed preferable to reduce the thickness of the strip 8 in several clearly separated stages, the installation according to the invention can be equipped with a second cold rolling mill, disposed after the annealing-pickling section, for example. The second cold rolling mill can be followed by another annealing-pickling section.

It goes without saying that the installation according to the invention is complemented by any ancillary plant usually encountered in independent installations known in the art and not mentioned in the present description, such as plant for monitoring the surface quality and flatness of the product.

If it is possible, without interrupting the operation of the cold rolling installation, to process a quantity of steel greater than that which the continuous casting installation can cast without interruption, a second continuous casting installation (optionally equipped with its own hot rolling mill and/or its own annealing furnace) can be provided, in conjunction with a butt-jointing installation for joining the end of the strip cast by one of the continuous casting installations to the beginning of the strip cast by the other continuous casting installation. They could be joined immediately upstream of the "descaling" part of the installation, for example.

For controlling the installation, preferably by means of a computer, the composition, the other metallurgical characteristics and the final thickness of the strip 8 are chosen and the operating parameters of the various parts of the installation are set according to the metallurgical imperatives to be complied with and the respective rates of production of the various components of the installation. As a general rule, the reference step relative to which the operating parameters of the installation must be set is the time the strip 8 spends in the annealing furnace 26. The duration required of this step, as calculated for a strip 8 of given thickness at this stage of fabrication, conditions, in particular:

- the rate at which the strip 8 is cast in the continuous casting machine 1 and its thickness on leaving said machine 1,
- the distribution of the reduction in the thickness of the strip 8 between the hot rolling step in the hot rolling mill 10 (if there is one in the installation) and the cold rolling step or steps in the rolling mill 21, and
- the lengths of the strip 8 contained in the various accumulators 12, 20, 25, 32, 35, these accumulators (of which there can be more or fewer than referred to here by way of example) impart adequate operational flexibility to the installation, for example, and prevent the strip 8 remaining for too short a time in the pickling tanks 16, 17, 28, 29, which would cause insufficient pickling, or for too long a time, which would cause overpickling and consume metal unnecessarily.

What is claimed is:

1. A method of fabricating thin stainless steel strip comprising the following steps performed successively and continuously on a single processing line:

(a) continuously casting a stainless steel strip directly from liquid stainless steel;

(b) descaling said strip;

(c) cold rolling said strip;

(d) annealing and pickling or bright annealing said strip;

(e) finishing said strip by passing said strip through a skin-pass rolling mill; and (f) coiling said strip, wherein there is no step of intermediate coiling said strip between steps (a) and (f).

2. The method according to claim 1, wherein said strip is continuously cast between two internally cooled horizontal axis rolls turning in opposite directions.

3. The method according to claim 1, further comprising hot rolling said continuously cast strip.

4. The method according to claim 1, further comprising annealing said strip after continuously casting.

5. The method according to claim 3, further comprising annealing said strip after hot rolling.

6. The method according to claim 1, wherein said strip is descaled by at least one of shot peening, brushing and spraying a fluid onto said strip.

7. The method according to claim 6, further comprising passing the strip through a scale breaker prior to the descaling step.

8. The method according to claim 1, further comprising a second step of cold rolling said strip, optionally followed by an annealing and pickling step.

9. The method according to claim 1, further comprising controlling operation of said processing line in accordance with the required duration of the step of annealing said strip.

10. The method according to claim 1, wherein the stainless steel comprises SUS 409 ferritic stainless steel.

11. An installation for producing cold-rolled stainless steel strip, the installation comprising, in succession:

(a) an installation for continuously casting thin stainless steel strip directly from liquid stainless steel;

(b) a descaling installation;

(c) a cold rolling installation;

(d) an annealing-pickling installation or a bright annealing installation;

(e) an installation for finishing the strip; and (f) an installation for coiling the strip, all said installations being disposed on a common continuous line and at least some of said installations being separated by a strip accumulator and wherein there is no installation for intermediate coiling the strip between installations (a) and (f).

12. The installation according to claim 11, wherein the installation for finishing the strip comprises a skin-pass rolling mill.

13. The installation according to claim 11, wherein said continuous casting installation comprises two internally cooled horizontal axis rolls turning in opposite directions.

14. The installation according to claim 11, further comprising a hot rolling mill downstream of the continuous casting installation.

15. The installation according to claim 11, further comprising an annealing furnace downstream of the casting installation.

16. The installation according to claim 14, further comprising an annealing furnace downstream of the hot rolling mill.

17. The installation according to claim 11, wherein the descaling installation includes at least one of a shot peening installation, a brushing installation and an installation for spraying a fluid onto the surface of the strip.

18. The installation according to claim 17, further comprising a scale breaker preceding the descaling installation.

19. The installation according to claim 1, further comprising an installation for pickling the strip after the descaling installation.

20. The installation according to claim 1, wherein the annealing installation has at its entry a system for induction heating the strip.

21. The installation according to claim 1, further comprising a second installation for cold rolling the strip, optionally followed by a second annealing-pickling installation.

22. The installation according to claim 12, further comprising a tension leveller after the skin-pass rolling mill.

23. The installation according to claim 1, further comprising a second continuous casting installation and a butt-jointing installation for joining the end of the strip cast by one of the continuous casting installations to the beginning of the strip cast by the other continuous casting installation.

24. The installation according to claim 11, further comprising a controller for controlling all said installations in accordance with time of the strip in the annealing installation.

* * * * *